US012221746B2

(12) United States Patent
Ito et al.

(10) Patent No.: US 12,221,746 B2
(45) Date of Patent: Feb. 11, 2025

(54) TREATMENT AGENT FOR CARBON FIBER PRECURSORS, AND CARBON FIBER PRECURSOR

(71) Applicant: TAKEMOTO YUSHI KABUSHIKI KAISHA, Aichi-ken (JP)

(72) Inventors: Jun Ito, Gamagori (JP); Keiichiro Oshima, Gamagori (JP); Yohei Suzuki, Gamagori (JP)

(73) Assignee: TAKEMOTO YUSHI KABUSHIKI KAISHA, Aichi-ken (JP)

( * ) Notice: Subject to any disclaimer, the term of this patent is extended or adjusted under 35 U.S.C. 154(b) by 0 days.

(21) Appl. No.: 18/563,646

(22) PCT Filed: Jun. 2, 2022

(86) PCT No.: PCT/JP2022/022416

§ 371 (c)(1),
(2) Date: Nov. 22, 2023

(87) PCT Pub. No.: WO2022/255434

PCT Pub. Date: Dec. 8, 2022

(65) Prior Publication Data

US 2024/0240389 A1 Jul. 18, 2024

(30) Foreign Application Priority Data

Jun. 4, 2021 (JP) ..... 2021-094515

(51) Int. Cl.

| | |
|---|---|
| ***D06M 15/53*** | (2006.01) |
| ***D06M 15/643*** | (2006.01) |
| ***D06M 15/647*** | (2006.01) |
| ***D06M 101/26*** | (2006.01) |

(52) U.S. Cl.

CPC ..... *D06M 15/53* (2013.01); *D06M 15/6436* (2013.01); *D06M 15/647* (2013.01); *D06M 2101/26* (2013.01); *D06M 2200/40* (2013.01)

(58) Field of Classification Search

CPC ..... D06M 15/53; D06M 15/6436; D06M 15/647; D06M 2101/26; D06M 2200/40

See application file for complete search history.

(56) References Cited

U.S. PATENT DOCUMENTS

| | | | |
|---|---|---|---|
| 2017/0284016 A1 | 10/2017 | Aso et al. | |
| 2019/0234014 A1* | 8/2019 | Arakawa | C08L 83/06 |
| 2022/0275539 A1 | 9/2022 | Nishigawa et al. | |

FOREIGN PATENT DOCUMENTS

| | | |
|---|---|---|
| JP | S60-181322 A | 9/1985 |
| JP | 2016-056496 A | 4/2016 |
| JP | 2019-007097 A | 1/2019 |
| WO | 2018/100786 A1 | 6/2018 |
| WO | 2021/070796 A1 | 4/2021 |

OTHER PUBLICATIONS

PCT/JP2022/022416, Jul. 12, 2022, International Search Report.
JP 2021-094515, Sep. 1, 2021, Notice of Reasons for Refusal.
International Search Report dated Jul. 12, 2022, in connection with International Application No. PCT/JP2022/022416.
Notice of Reasons for Refusal dated Sep. 1, 2021, in connection with Japanese Application No. 2021-094515.

* cited by examiner

*Primary Examiner* — Andrew J. Oyer
(74) *Attorney, Agent, or Firm* — Wolf, Greenfield & Sacks, P.C.

(57) ABSTRACT

Disclosed is a carbon fiber precursor treatment agent that contains a specific (poly)oxyalkylene derivative and a smoothing agent. The smoothing agent contains at least one selected from the group consisting of an amino-modified silicone, a polyether-modified silicone, a dimethyl silicone, and an ester compound. Assuming that the sum of the content ratios of the (poly)oxyalkylene derivative and the smoothing agent in the carbon fiber precursor treatment agent is 100% by mass, the carbon fiber precursor treatment agent contains the (poly)oxyalkylene derivative at a ratio of 5% by mass or more and 80% by mass or less and the smoothing agent at a ratio of 20% by mass or more and 95% by mass or less.

7 Claims, No Drawings

TREATMENT AGENT FOR CARBON FIBER PRECURSORS, AND CARBON FIBER PRECURSOR

CROSS REFERENCE TO RELATED APPLICATIONS

This Application is a national stage filing under 35 U.S.C. 371 of International Patent Application Serial No PCT/JP2022/022416, filed Jun. 2, 2022, which claims priority to Japanese application number 2021-094515 filed, Jun. 4, 2021. The entire contents of these applications are incorporated herein by reference in their entirety.

TECHNICAL FIELD

The present invention relates to a carbon fiber precursor treatment agent and a carbon fiber precursor.

BACKGROUND ART

Carbon fibers are produced by, for example, performing a spinning step of spinning an acrylic resin or the like into fibers to prepare a carbon fiber precursor and a firing step of firing the carbon fiber precursor.

In order to improve qualities of the carbon fiber precursor, such as antistatic properties and bundling properties, a carbon fiber precursor treatment agent may be used in the spinning step.

Patent Document 1 discloses an oil agent for a carbon fiber precursor, as a carbon fiber precursor treatment agent, containing a base component, a cationic surfactant, and a nonionic surfactant.

CITATION LIST

Patent Literature

Patent Document 1: International Publication No. WO 2018/100786

SUMMARY OF INVENTION

Technical Problem

The carbon fiber precursor treatment agent is required to have improved wettability to a carbon fiber precursor in order to further improve the qualities of the carbon fiber precursor. The carbon fiber precursor treatment agent is also required to improve qualities of a carbon fiber obtained by firing the carbon fiber precursor. Examples of the qualities of the carbon fiber include suppression of fusion between carbon fibers and strength of the carbon fiber.

Solution to Problem

To solve the above problem, there is provided a carbon fiber precursor treatment agent that contains a (poly)oxyalkylene derivative (A) represented by Chemical Formula 1 below and a smoothing agent (B). The smoothing agent (B) contains, for example, at least one selected from the group consisting of an amino-modified silicone, a polyether-modified silicone, a dimethyl silicone, and an ester compound.

[Chemical Formula 1]

$$R^1O-(AO)_n-H$$

In Chemical Formula 1, $R^1$ is an aliphatic hydrocarbon group having 3 or more methyl groups and 4 or more and 24 or less carbon atoms, AO is an alkyleneoxy group having 2 or more and 4 or less carbon atoms, provided that when a plurality of the alkyleneoxy groups are present, one kind of the alkyleneoxy groups may be used alone, or two or more kinds of the alkyleneoxy groups may be used, and n is an integer of 1 or more and 30 or less.

In the carbon fiber precursor treatment agent, the $R^1$ in Chemical Formula 1 is preferably an aliphatic hydrocarbon group having 3 or more methyl groups and 8 or more and 11 or less carbon atoms.

In the carbon fiber precursor treatment agent, the alkyleneoxy group preferably contains an ethyleneoxy group.

In the carbon fiber precursor treatment agent, the alkyleneoxy group preferably contains an ethyleneoxy group and a propyleneoxy group.

In the carbon fiber precursor treatment agent, the smoothing agent (B) preferably contains at least one selected from the group consisting of an amino-modified silicone and a polyether-modified silicone.

In the carbon fiber precursor treatment agent, the smoothing agent (B) preferably contains the amino-modified silicone and the polyether-modified silicone.

Assuming that the sum of the content ratios of the (poly)oxyalkylene derivative (A) and the smoothing agent (B) in the carbon fiber precursor treatment agent is 100% by mass, the carbon fiber precursor treatment agent preferably contains the (poly)oxyalkylene derivative (A) at a ratio of 5% by mass or more and 80% by mass or less and the smoothing agent (B) at a ratio of 20% by mass or more and 95% by mass or less.

To solve the above problem, there is provided a carbon fiber precursor to which the carbon fiber precursor treatment agent adhered.

Advantageous Effects of Invention

The present invention succeeds in improving wettability to a carbon fiber precursor. In addition, it is possible to suppress fusion between carbon fibers and to improve strength of a carbon fiber.

DESCRIPTION OF EMBODIMENTS

First Embodiment

A first embodiment in which the carbon fiber precursor treatment agent (also simply referred to hereinafter as treatment agent) of the present invention is embodied will be described.

A treatment agent of the present embodiment contains a (poly)oxyalkylene derivative (A) represented by Chemical Formula 2 below and a smoothing agent (B).

[Chemical Formula 2]

$$R^1O-(AO)_n-H$$

In Chemical Formula 2, $R^1$ is an aliphatic hydrocarbon group having 3 or more methyl groups and 4 or more and 24 or less carbon atoms, AO is an alkyleneoxy group having 2 or more and 4 or less carbon atoms, provided that when a plurality of the alkyleneoxy groups are present, one kind of the alkyleneoxy groups may be used alone, or two or more kinds of the alkyleneoxy groups may be used, and n is an integer of 1 or more and 30 or less.

The treatment agent contains the (poly)oxyalkylene derivative (A), so that the wettability to a carbon fiber precursor is improved. In addition, it is possible to suppress fusion between carbon fibers and to improve strength of a carbon fiber.

An aliphatic hydrocarbon forming the aliphatic hydrocarbon group having 4 or more and 24 or less carbon atoms is not particularly limited, and may be a saturated aliphatic hydrocarbon or an unsaturated aliphatic hydrocarbon.

The aliphatic hydrocarbon group has preferably 6 or more and 20 or less carbon atoms, more preferably 8 or more and 18 or less carbon atoms, and further preferably 8 or more and 11 or less carbon atoms.

The number of carbon atoms of the aliphatic hydrocarbon group is 8 or more and 11 or less, thereby making it possible to more suitably suppress fusion between the carbon fibers prepared using the carbon fiber precursor to which the treatment agent is adhered.

The methyl group includes also $CH_3$ of a substituent other than the methyl group. For example, when the aliphatic hydrocarbon group has an ethyl group as a branched chain, $CH_3$ located at a terminal of the ethyl group is also counted as the methyl group.

Examples of the alkyleneoxy group having 2 or more and 4 or less carbon atoms include an ethyleneoxy group, a propyleneoxy group, and a butyleneoxy group. Among these groups, those containing an ethyleneoxy group are preferable. In addition, those containing an ethyleneoxy group and a propyleneoxy group are more preferable.

The (poly)oxyalkylene derivative (A) contains an ethyleneoxy group and a propyleneoxy group as the alkyleneoxy groups having 2 or more and 4 or less carbon atoms, so that wettability to the carbon fiber precursor can be further improved.

The (poly)oxyalkylene derivative (A) is composed of a (poly)oxyalkylene alkyl ether obtained by adding an alkylene oxide having 2 or more and 4 or less carbon atoms to an aliphatic alcohol having 3 or more methyl groups and 4 or more and 24 or less carbon atoms in a proportion of 1 mol or more and 30 mol or less in total.

A polymerization sequence of the alkylene oxide is not particularly limited, and may be a random adduct or a block adduct.

The alkylene oxide may be used alone or in combination of two or more kinds thereof.

Specific examples of the (poly)oxyalkylene derivative (A) include a compound obtained by adding 8 mol of ethylene oxide and 2 mol of propylene oxide to 1 mol of 3,5,5-trimethyl-1-hexanol, a compound obtained by adding 12 mol of ethylene oxide and 12 mol of propylene oxide to 1 mol of 3,5,5-trimethyl-1-hexanol, a compound obtained by adding 5 mol of ethylene oxide and 5 mol of propylene oxide to 1 mol of 3,5-dimethyl-1-hexanol, a compound obtained by adding 7 mol of ethylene oxide and 3 mol of propylene oxide to 1 mol of 0-citronellol, a compound obtained by adding 3 mol of ethylene oxide and 3 mol of propylene oxide to 1 mol of 3,7,7-trimethyl-1-octanol, a compound obtained by adding 6 mol of ethylene oxide to 1 mol of 3,5,5-trimethyl-1-hexanol, a compound obtained by adding 5 mol of ethylene oxide and 5 mol of propylene oxide to 1 mol of 3,7,9-trimethyl-1-decanol, and a compound obtained by adding 5 mol of ethylene oxide to 1 mol of 2-(4-methylhexyl)-8 methyl-1-dodecanol.

The (poly)oxyalkylene derivative (A) may be used alone or in combination of two or more kinds thereof.

The smoothing agent (B) is not particularly limited, and known smoothing agents used in a treatment agent can be used. Examples of the known smoothing agents include a silicone oil, a mineral oil, a polyolefin, and an ester compound. The smoothing agents may be used alone or in combination of two or more kinds thereof. Among them, the smoothing agent (B) preferably includes a silicone oil.

Examples of the silicone oil include a dimethyl silicone, a phenyl-modified silicone, an amino-modified silicone, an amide-modified silicone, a polyether-modified silicone, an aminopolyether-modified silicone, an alkyl-modified silicone, an alkylaralkyl-modified silicone, an alkylpolyether-modified silicone, an ester-modified silicone, an epoxy-modified silicone, a carbinol-modified silicone, and a mercapto-modified silicone. Among these silicones, the smoothing agent (B) preferably includes at least one selected from the group consisting of an amino-modified silicone and a polyether-modified silicone. In addition, the smoothing agent (B) more preferably includes an amino-modified silicone and a polyether-modified silicone.

The smoothing agent (B) includes at least one selected from the group consisting of an amino-modified silicone and a polyether-modified silicone, so that at least any one of wettability to the carbon fiber precursor, strength of the carbon fiber, and suppression of fusibility of the carbon fibers can be made more suitable.

In addition, the smoothing agent (B) includes an amino-modified silicone and a polyether-modified silicone, thereby making it possible to further improve the strength of the carbon fiber, and to more suitably suppress fusion between the carbon fibers.

Specific examples of the smoothing agent (B) include an amino-modified silicone having a kinematic viscosity at 25° C. of 650 $mm^2/s$ and an amino equivalent of 1800 g/mol, an amino-modified silicone having a kinematic viscosity at 25° C. of 90 mm 2/s and an amino equivalent of 5000 g/mol, an amino-modified silicone having a kinematic viscosity at 25° C. of 4500 $mm^2/s$ and an amino equivalent of 1200 g/mol, an amino-modified silicone having a kinematic viscosity at 25° C. of 8000 $mm^2/s$ and an amino equivalent of 1000 g/mol, a polyether-modified silicone having a kinematic viscosity at 25° C. of 600 $mm^2/s$, silicone main chain/polyether side chain=30/70 (mass ratio), and ethylene oxide/propylene oxide=20/80 (molar ratio), a polyether-modified silicone having a kinematic viscosity at 25° C. of 1700 $mm^2/s$, silicone main chain/polyether side chain=50/50 (mass ratio), and ethylene oxide/propylene oxide=50/50 (molar ratio), a dimethyl silicone having a kinematic viscosity at 25° C. of 1000 $mm^2/s$, and a didodecyl ester of ethylene oxide 2 mol adduct of bisphenol A.

The silicone oils described above may be used alone or in combination of two or more kinds thereof.

The kinematic viscosity of the smoothing agent (B) can be measured by a known method under the condition of 25° C. using a Cannon-Fenske viscometer.

The content ratios of the (poly)oxyalkylene derivative (A) and the smoothing agent (B) in the treatment agent are not limited. Assuming that the sum of the content ratios of the (poly)oxyalkylene derivative (A) and the smoothing agent (B) in the treatment agent is 100% by mass, the treatment agent preferably contains the (poly)oxyalkylene derivative (A) at a ratio of 5% by mass or more and 80% by mass or less and the smoothing agent (B) at a ratio of 20% by mass or more and 95% by mass or less.

In addition, the treatment agent more preferably contains the (poly)oxyalkylene derivative (A) at a ratio of 20% by mass or more and 50% by mass or less and the smoothing agent (B) at a ratio of 50% by mass or more and 80% by mass or less.

Second Embodiment

A second embodiment in which the carbon fiber precursor of the present invention is embodied will be described. The treatment agent of the first embodiment is adhered to the carbon fiber precursor of the present embodiment. Specific examples of the carbon fiber precursor include, without any particular limitation, (1) a polyester fiber, such as polyethylene terephthalate, polypropylene terephthalate, and polylactic acid ester, (2) a polyamide fiber, such as nylon 6 and nylon 66, (3) a polyacryl fiber, such as polyacryl and modacryl, (4) a polyolefin fiber, such as polyethylene and polypropylene, (5) a cellulose fiber, and (6) a lignin fiber. The carbon fiber precursor is preferably a synthetic fiber made of a resin that becomes a carbon fiber through a carbonization step which will be described later. The resin forming the carbon fiber precursor is not particularly limited, and examples thereof include an acrylic resin, a polyethylene resin, a phenol resin, a cellulose resin, a lignin resin, and pitch.

The ratio of adhering the treatment agent of the first embodiment to the carbon fiber precursor is not particularly limited, but the treatment agent (not containing a solvent) is adhered to the carbon fiber precursor preferably at a ratio of 0.1% by mass or more and 2% by mass or less, and more preferably at a ratio of 0.3% by mass or more and 1.2% by mass or less.

Examples of a form of the treatment agent when the treatment agent of the first embodiment is adhered to the carbon fiber precursor include an organic solvent solution and an aqueous solution.

As a method of adhering the treatment agent to the carbon fiber precursor, a method can be applied, for example, in which the treatment agent of the first embodiment and an aqueous solution containing water or a further diluted aqueous solution are used to adhere the treatment agent to the carbon fiber precursor by a known method such as an immersion method, a spray method, a roller method, or a guide lubricating method using a metering pump.

A method for producing a carbon fiber using the carbon fiber precursor of the present embodiment will be described.

The method for producing a carbon fiber preferably includes the following steps 1 to 3.

Step 1: a spinning step of spinning a synthetic fiber to be a carbon fiber precursor and adhering the treatment agent of the first embodiment to the synthetic fiber.

Step 2: a flameproofing step of converting the carbon fiber precursor obtained in step 1 above into a flameproofed fiber in an oxidizing atmosphere at 200° C. or higher and 300° C. or lower, preferably 230° C. or higher and 270° C. or lower.

Step 3: a carbonization step of carbonizing the flameproofed fiber obtained in step 2 above in an inert atmosphere at 300° C. or higher and 2000° C. or lower, preferably 300° C. or higher and 1300° C. or lower.

A firing step is constituted by step 2 and step 3 above.

The spinning step preferably includes a wet spinning step of dissolving a resin in a solvent to spin the resin, a dry densification step of drying and densifying the wet-spun synthetic fiber, and a stretching step of stretching the dry densified synthetic fiber. The treatment agent of the first embodiment is preferably adhered between the wet spinning step and the dry densification step.

A temperature in the dry densification step is not particularly limited, but the synthetic fiber subjected to the wet spinning step is preferably heated at, for example, 70° C. or higher and 200° C. or lower. A timing of adhering the treatment agent to the synthetic fiber is not particularly limited, but is preferably between the wet spinning step and the dry densification step.

The oxidizing atmosphere in the flameproofing step is not particularly limited, and, for example, an air atmosphere can be used.

The inert atmosphere in the carbonization step is not particularly limited, and, for example, a nitrogen atmosphere, an argon atmosphere, or a vacuum atmosphere can be used.

The treatment agent and carbon fiber precursor of the present embodiment can provide the following actions and effects.

(1) The treatment agent of the present embodiment contains a (poly)oxyalkylene derivative (A) represented by Chemical Formula 2 above and a smoothing agent (B). Thus, wettability to the carbon fiber precursor is improved. In addition, it is possible to suppress fusion between carbon fibers and to improve strength of a carbon fiber.

(2) The number of carbon atoms of the aliphatic hydrocarbon group of the (poly)oxyalkylene derivative (A) is 8 or more and 11 or less, thereby making it possible to more suitably suppress fusion between the carbon fibers prepared using the carbon fiber precursor to which the treatment agent is adhered.

(3) The (poly)oxyalkylene derivative (A) contains an ethyleneoxy group and a propyleneoxy group as the alkyleneoxy groups having 2 or more and 4 or less carbon atoms, thereby making it possible to further improve wettability to the carbon fiber precursor.

(4) The smoothing agent (B) includes at least one selected from the group consisting of an amino-modified silicone and a polyether-modified silicone, thereby making it possible to make more suitable at least any one of wettability to the carbon fiber precursor, strength of the carbon fiber, and suppression of fusibility of the carbon fibers.

(5) The smoothing agent (B) includes an amino-modified silicone and a polyether-modified silicone, thereby making it possible to more suitably suppress fusion between the carbon fibers prepared using the carbon fiber precursor to which the treatment agent is adhered, and to further improve the strength of the carbon fiber.

The above embodiments can be modified as follows. The above embodiments and the following modifications can be implemented in combination with each other as long as there is no technical contradiction.

In the present embodiment, the treatment agent is adhered to a carbon fiber precursor between the wet spinning step and the dry densification step, but the present invention is not limited to this aspect. The treatment agent may be adhered to a carbon fiber precursor between the dry densification step and the stretching step, or may be adhered thereto between the stretching step and the flameproofing step.

The treatment agent of the present embodiment may further contain a component commonly used in a treatment agent, such as a stabilizer, an antistatic agent, an antistat, a binding agent, an antioxidant, an ultraviolet absorber, or an antifoaming agent (silicone compound) for maintaining the qualities of the treatment agent as long as the effects of the present invention are not impaired.

EXAMPLES

Examples will now be given below to describe the features and effects of the present invention more specifically, but the present invention is not limited to these examples. In the following description of the working examples and comparative examples, "parts" means parts by mass, and "%" means % by mass.

Experimental Part 1 (Preparation of Carbon Fiber Precursor Treatment Agent)

Example 1

The respective components shown in Table 1 were added to a beaker in blending ratios of 50 parts for the (poly) oxyalkylene derivative (A-1), 40 parts for the smoothing agent (B-1), and 10 parts for the smoothing agent (B-5). These components were stirred and mixed well. While stirring was continued, ion-exchanged water was gradually added so that the solid content concentration was 25%, thereby preparing a 25% aqueous solution of a carbon fiber precursor treatment agent of Example 1.

Examples 2 to 21 and Comparative Examples 1 and 2

Each of carbon fiber precursor treatment agents of Examples 2 to 21 and Comparative Examples 1 and 2 was prepared in the same manner as in Example 1 using the respective components shown in Table 1.

The kind and content of the (poly)oxyalkylene derivative (A) and the kind and content of the smoothing agent (B) in the treatment agent of each of the examples are as shown in the "(poly)oxyalkylene derivative (A)" column and the "smoothing agent (B)" column of Table 1, respectively.

TABLE 1

| | (Poly)oxyalkylene derivative (A) | | Smoothing agent (B) | | | | |
|---|---|---|---|---|---|---|---|
| | | Parts | | Parts | Evaluation | | |
| | Kind | by mass | Kind | by mass | Wetta-bility | Strength | Fu-sion |
| Example 1 | A-1 | 50 | B-1 | 40 | ○○○ | ○○ | ○○○ |
| | | | B-5 | 10 | | | |
| Example 2 | A-1 | 50 | B-2 | 40 | ○○○ | ○○ | ○○○ |
| | | | B-5 | 10 | | | |
| Example 3 | A-1 | 50 | B-3 | 40 | ○○○ | ○○ | ○○○ |
| | | | B-5 | 10 | | | |
| Example 4 | A-1 | 50 | B-4 | 40 | ○○○ | ○○ | ○○○ |
| | | | B-5 | 10 | | | |
| Example 5 | A-1 | 50 | B-1 | 40 | ○○○ | ○○ | ○○○ |
| | | | B-6 | 10 | | | |
| Example 6 | A-1 | 50 | B-2 | 40 | ○○○ | ○○ | ○○○ |
| | | | B-6 | 10 | | | |
| Example 7 | A-2 | 50 | B-1 | 40 | ○○○ | ○○ | ○○○ |
| | | | B-5 | 10 | | | |
| Example 8 | A-3 | 50 | B-3 | 40 | ○○○ | ○○ | ○○○ |
| | | | B-6 | 10 | | | |
| Example 9 | A-4 | 50 | B-4 | 40 | ○○○ | ○○ | ○○○ |
| | | | B-6 | 10 | | | |
| Example 10 | A-4 | 50 | B-1 | 40 | ○○○ | ○○ | ○○○ |
| | | | B-5 | 10 | | | |
| Example 11 | A-5 | 50 | B-1 | 40 | ○○○ | ○○ | ○○○ |
| | | | B-5 | 10 | | | |

TABLE 1-continued

| | (Poly)oxyalkylene derivative (A) | | Smoothing agent (B) | | | | |
|---|---|---|---|---|---|---|---|
| | | Parts | | Parts | Evaluation | | |
| | Kind | by mass | Kind | by mass | Wetta-bility | Strength | Fu-sion |
| Example 12 | A-1 | 25 | B-1 | 35 | ○○○ | ○○ | ○○○ |
| | | | B-5 | 40 | | | |
| Example 13 | A-1 | 10 | B-1 | 85 | ○○○ | ○○ | ○○○ |
| | | | B-5 | 5 | | | |
| Example 14 | A-1 | 75 | B-1 | 15 | ○○○ | ○○ | ○○○ |
| | | | B-5 | 10 | | | |
| Example 15 | A-7 | 50 | B-1 | 40 | ○○○ | ○○ | ○○ |
| | | | B-5 | 10 | | | |
| Example 16 | A-6 | 50 | B-1 | 40 | ○○ | ○○ | ○○○ |
| | | | B-5 | 10 | | | |
| Example 17 | A-1 | 50 | B-1 | 50 | ○○ | ○○ | ○○○ |
| Example 18 | A-1 | 50 | B-5 | 50 | ○○○ | ○ | ○○ |
| Example 19 | A-1 | 50 | B-7 | 50 | ○○ | ○ | ○○ |
| Example 20 | A-1 | 50 | B-8 | 50 | ○○ | ○ | ○○ |
| Example 21 | A-8 | 50 | B-7 | 50 | ○ | ○ | ○ |
| Comparative Example 1 | a-1 | 50 | B-1 | 50 | x | ○ | x |
| Comparative Example 2 | a-2 | 50 | B-7 | 50 | x | x | x |

Details of the (poly)oxyalkylene derivative (A) and the smoothing agent (B) in Table 1 are as follows.

((Poly)Oxyalkylene Derivative (A))

- A-1: compound obtained by adding 8 mol of ethylene oxide and 2 mol of propylene oxide to 1 mol of 3,5,5-trimethyl-1-hexanol
- A-2: compound obtained by adding 12 mol of ethylene oxide and 12 mol of propylene oxide to 1 mol of 3,5,5-trimethyl-1-hexanol
- A-3: compound obtained by adding 5 mol of ethylene oxide and 5 mol of propylene oxide to 1 mol of 3,5 dimethyl-1-hexanol
- A-4: compound obtained by adding 7 mol of ethylene oxide and 3 mol of propylene oxide to 1 mol of β-citronellol
- A-5: compound obtained by adding 3 mol of ethylene oxide and 3 mol of propylene oxide to 1 mol of 3,7,7-trimethyl-1-octanol
- A-6: compound obtained by adding 6 mol of ethylene oxide to 1 mol of 3,5,5 trimethyl-1-hexanol
- A-7: compound obtained by adding 5 mol of ethylene oxide and 5 mol of propylene oxide to 1 mol of 3,7,9-trimethyl-1-decanol
- A-8: compound obtained by adding 5 mol of ethylene oxide to 1 mol of 2-(4-methylhexyl)-8-methyl-1-dodecanol
- a-1: compound obtained by adding 9 mol of ethylene oxide and 1 mol of propylene oxide to 1 mol of 1-decanol
- a-2: compound obtained by adding 5 mol of ethylene oxide to 1 mol of 1-dodecyl alcohol The number of carbon atoms of the aliphatic hydrocarbon group, the number of methyl groups, the kind of alkyleneoxy groups, and the number of moles of added alkyleneoxy groups of the (poly)oxyalkylene derivative (A) are shown in the "Number of carbon atoms of aliphatic hydrocarbon group" column, the "Number of methyl groups" column, the "Kind of alkyleneoxy group" column, and the "number of moles of added alkyleneoxy group" column of Table 2, respectively.

In Table 2, "EO" means an ethyleneoxy group, and "PO" means a propyleneoxy group. The number in parentheses means the number of moles added.

TABLE 2

| Kind of (poly)oxyalkylene derivative (A) | Number of carbon atoms of aliphatic hydrocarbon group | Number of methyl groups | Kind of alkyleneoxy group |
|---|---|---|---|
| A-1 | 9 | 4 | EO(8), PO(2) |
| A-2 | 9 | 4 | EO(12), PO(12) |
| A-3 | 8 | 3 | EO(5), PO(5) |
| A-4 | 10 | 3 | EO(7), PO(3) |
| A-5 | 11 | 4 | EO(3), PO(3) |
| A-6 | 9 | 4 | EO(6) |
| A-7 | 13 | 4 | EO(5), PO(5) |
| A-8 | 18 | 4 | EO(5) |
| a-1 | 10 | 1 | EO(9), PO(1) |
| a-2 | 12 | 1 | EO(5) |

(Smoothing Agent (B))

B-1: amino-modified silicone having a kinematic viscosity at 25° C. of 650 $mm^2/s$ and an amino equivalent of 1800 g/mol B-2: amino-modified silicone having a kinematic viscosity at 25° C. of 90 $mm^2/s$ and an amino equivalent of 5000 g/mol B-3: amino-modified silicone having a kinematic viscosity at 25° C. of 4500 $mm^2/s$ and an amino equivalent of 1200 g/mol B-4: amino-modified silicone having a kinematic viscosity at 25° C. of 8000 $mm^2/s$ and an amino equivalent of 1000 g/mol B-5: polyether-modified silicone having a kinematic viscosity at 25° C. of 600 $mm^2/s$, silicone main chain/polyether side chain=30/70 (mass ratio), and ethylene oxide/propylene oxide=20/80 (molar ratio)

B-6: polyether-modified silicone having a kinematic viscosity at 25° C. of 1700 $mm^2/s$, silicone main chain/polyether side chain=50/50 (mass ratio), and ethylene oxide/propylene oxide=50/50 (molar ratio)

B-7: dimethyl silicone having a kinematic viscosity at 25° C. of 1000 $mm^2/s$

B-8: didodecyl ester of ethylene oxide 2 mol adduct of bisphenol A Experimental Part 2 (Carbon fiber precursor and production of carbon fiber) A carbon fiber precursor and a carbon fiber were produced using the aqueous solution of the carbon fiber precursor treatment agent prepared in Experimental Part 1.

First, as step 1, an acrylic resin was wet-spun. Specifically, a copolymer composed of 95% by mass of acrylonitrile, 3.5% by mass of methyl acrylate, and 1.5% by mass of methacrylic acid and having a limiting viscosity of 1.80 was dissolved in dimethylacetamide (DMAC) to prepare a spinning dope having a polymer concentration of 21.0% by mass and a viscosity at 60° C. of 500 poise. The spinning dope was discharged from a spinneret having a hole diameter (inner diameter) of 0.075 mm and the number of holes of 12,000 at a draft ratio of 0.8 into a coagulation bath of a 70% by mass aqueous solution of DMAC kept at a spinning bath temperature of 35° C.

The coagulated yarn was stretched 5 times in a water washing tank simultaneously with desolvation to prepare a water-swollen acrylic fiber strand (raw material fiber). The carbon fiber precursor treatment agent prepared in Experimental Part 1 was fed to the acrylic fiber strand so that the amount of solid contents adhered was 1% by mass (not containing a solvent). The feeding of the carbon fiber precursor treatment agent was performed by an immersion method using a 4% ion-exchanged aqueous solution of the carbon fiber precursor treatment agent. Thereafter, the acrylic fiber strand was subjected to a dry densification treatment with a heating roller at 130° C., further stretched 1.7 times between heating rollers at 170° C., and then wound around a yarn tube using a winding device.

Next, as step 2, a yarn was unwound from the wound carbon fiber precursor, subjected to a flameproofing treatment in an air atmosphere for 1 hour in a flameproofing furnace having a temperature gradient of 230° C. or higher and 270° C. or lower, and then wound around a yarn tube to obtain a flameproofed yarn (flameproofed fiber).

Next, as step 3, a yarn was unwound from the wound flameproofed yarn, and fired in a carbonization furnace having a temperature gradient of 300° C. or higher and 1300° C. or lower in a nitrogen atmosphere to convert the yarn into a carbon fiber, and then the carbon fiber was wound around a yarn tube.

Experimental Part 3 (Evaluation)

For each of the treatment agents of Examples 1 to 21 and Comparative Examples 1 and 2, the wettability of the treatment agent, the strength of the carbon fiber, and the fusibility between the carbon fibers were each evaluated by the procedures which will be described below.

(Wettability)

A 4% ion-exchanged aqueous solution of an active ingredient of the carbon fiber precursor treatment agent (containing a component other than ion-exchanged water as the active ingredient) was prepared, and 0.1 g of the ion-exchanged aqueous solution was added dropwise onto an acrylic plate. The maximum diameter (mm) after 1 minute was measured and evaluated according to the following criteria. The evaluation results are shown in the "Wettability" column of Table 1.

Evaluation Criteria for Wettability

○○○ (excellent): The maximum diameter is 12 mm or more.

○○ (good): The maximum diameter is 11 mm or more and less than 12 mm.

○ (fair): The maximum diameter is 10 mm or more and less than 11 mm.

x (poor): The maximum diameter is less than 10 mm.

(Strength)

Using the carbon fiber obtained in step 3 of Experimental Part 2, the strength of the carbon fiber was measured in accordance with JIS R 7606 (corresponding international standard ISO 11566:1996). The strength was evaluated according to the following criteria. The evaluation results are shown in the "Strength" column of Table 1.

Evaluation Criteria for Strength

○○ (good): Strength of 4.5 GPa or more

○ (fair): Strength of 4.0 GPa or more and less than 4.5 GPa x (poor): Strength of less than 4.0 GPa (Fusibility)

Ten (10) sites were randomly selected from the carbon fiber obtained in step 3 of Experimental Part 3, and 1-cm short fibers were cut out. The fusion state was visually observed, and the number of fusions per site was counted. The strength was evaluated according to the following criteria. The evaluation results are shown in the "Fusion" column of Table 1.

Evaluation Criteria for Fusion

○○○ (excellent): The number of fusions is 0 or more and less than 2.

○○ (good): The number of fusions is 2 or more and less than 5.

○ (fair): The number of fusions is 5 or more and less than 7.

x (poor): The number of fusions is 7 or more.

From the results in Table 1, according to the present invention, the wettability to the carbon fiber precursor is improved. In addition, the fusion between the carbon fibers can be suppressed. In addition, the strength of the carbon fiber can be improved.

The present disclosure also encompasses the following embodiments.

Additional Embodiment 1

A carbon fiber precursor treatment agent comprising a (poly)oxyalkylene derivative (A) represented by Chemical Formula 1 below and a smoothing agent (B).

[Chemical Formula 3]

$$R^1O-(AO)_n-H$$

(In Chemical Formula 3, $R^1$ is an aliphatic hydrocarbon group having 3 or more methyl groups and 4 or more and 24 or less carbon atoms, AO is an alkyleneoxy group having 2 or more and 4 or less carbon atoms, provided that when a plurality of the alkyleneoxy groups are present, one kind of the alkyleneoxy groups may be used alone, or two or more kinds of the alkyleneoxy groups may be used, and n is an integer of 1 or more and 30 or less.)

Additional Embodiment 2

The carbon fiber precursor treatment agent according to additional embodiment 1, wherein the $R^1$ in Chemical Formula 3 is an aliphatic hydrocarbon group having 3 or more methyl groups and 8 or more and 11 or less carbon atoms.

Additional Embodiment 3

The carbon fiber precursor treatment agent according to additional embodiment 1 or 2, wherein the alkyleneoxy group contains an ethyleneoxy group.

Additional Embodiment 4

The carbon fiber precursor treatment agent according to any one of additional embodiments 1 to 3, wherein the alkyleneoxy group contains an ethyleneoxy group and a propyleneoxy group.

Additional Embodiment 5

The carbon fiber precursor treatment agent according to any one of additional embodiments 1 to 4, wherein the smoothing agent (B) contains at least one selected from the group consisting of an amino-modified silicone and a polyether-modified silicone.

Additional Embodiment 6

The carbon fiber precursor treatment agent according to additional embodiment 5, wherein the smoothing agent (B) contains the amino-modified silicone and the polyether-modified silicone.

Additional Embodiment 7

The carbon fiber precursor treatment agent according to any one of additional embodiments 1 to 6, wherein assuming that the sum of the content ratios of the (poly)oxyalkylene derivative (A) and the smoothing agent (B) in the carbon fiber precursor treatment agent is 100% by mass, the carbon fiber precursor treatment agent contains the (poly)oxyalkylene derivative (A) at a ratio of 5% by mass or more and 80% by mass or less and the smoothing agent (B) at a ratio of 20% by mass or more and 95% by mass or less.

Additional Embodiment 8

A carbon fiber precursor comprising the carbon fiber precursor treatment agent according to any one of additional embodiments 1 to 7 adhered thereto.

The invention claimed is:

1. A carbon fiber precursor treatment agent comprising a (poly)oxyalkylene derivative (A) and a smoothing agent (B), wherein the smoothing agent (B) contains at least one selected from the group consisting of an amino-modified silicone, a polyether-modified silicone, a dimethyl silicone, and an ester compound, assuming that the sum of the content ratios of the (poly) oxyalkylene derivative (A) and the smoothing agent (B) in the carbon fiber precursor treatment agent is 100% by mass, the carbon fiber precursor treatment agent contains the (poly)oxyalkylene derivative (A) at a ratio of 5% by mass or more and 80% by mass or less and the smoothing agent (B) at a ratio of 20% by mass or more and 95% by mass or less, and the (poly)oxyalkylene derivative is represented by the following chemical formula:

$$R^1O-(AO)_n-H$$

wherein R1 is an aliphatic hydrocarbon group having 3 or more methyl groups and 4 or more and 24 or less carbon atoms, AO is an alkyleneoxy group having 2 or more and 4 or less carbon atoms, provided that when the number of alkyleneoxy groups is two or more, all of them may be of the same alkyleneoxy type or of different alkyleneoxy types, and n is an integer of 1 or more and 30 or less.

2. The carbon fiber precursor treatment agent according to claim 1, wherein the R1 in Chemical Formula 1 is an aliphatic hydrocarbon group having 3 or more methyl groups and 8 or more and 11 or less carbon atoms.

3. The carbon fiber precursor treatment agent according to claim 1, wherein the alkyleneoxy group contains an ethyleneoxy group.

4. The carbon fiber precursor treatment agent according to claim 1, wherein the alkyleneoxy group contains an ethyleneoxy group and a propyleneoxy group.

5. The carbon fiber precursor treatment agent according to claim 1, wherein the smoothing agent (B) contains at least one selected from the group consisting of an amino-modified silicone and a polyether-modified silicone.

6. The carbon fiber precursor treatment agent according to claim 5, wherein the smoothing agent (B) contains the amino-modified silicone and the polyether-modified silicone.

7. A carbon fiber precursor comprising the carbon fiber precursor treatment agent according to claim 1 adhered thereto.

* * * * *